US006173746B1

(12) United States Patent
Debaes et al.

(10) Patent No.: US 6,173,746 B1
(45) Date of Patent: Jan. 16, 2001

(54) FABRICS WITH RIB STRUCTURE ON BOTH SIDES AND METHOD OF MANUFACTURING

(75) Inventors: Johnny Debaes, Moorslede; Ludo Smissaert, Assebroek; Nico Vandoorne, Rekkem, all of (BE)

(73) Assignee: N.V. Michael Van de Wiele, Kortrijk/Marke (BE)

( * ) Notice: Under 35 U.S.C. 154(b), the term of this patent shall be extended for 0 days.

(21) Appl. No.: 09/348,295

(22) Filed: Jul. 7, 1999

(30) Foreign Application Priority Data

Jul. 22, 1998 (BE) ..... 9800549

(51) Int. Cl.[7] ..... D03D 27/04

(52) U.S. Cl. ..... 139/392; 139/391; 139/37; 139/435.1; 139/383 R

(58) Field of Search ..... 139/37, 435.1, 139/383 R, 404, 418, 391, 402, 392

(56) References Cited

FOREIGN PATENT DOCUMENTS 1 306 287 2/1963 (FR) .

OTHER PUBLICATIONS

Van De Wiele, "Weave Catalogue," XP000648112, 1983, Van De Wiele, Belgium, pp. 1, 4–6, 8.

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A method for weaving fabrics with a two-sided rib structure, such as false bouclé fabrics, comprises forming a fabric on a weaving machine from weft threads and warp threads of a series of warp thread systems, with sets of at least two weft threads running one above the other. Each warp thread system comprises at least three pattern warp threads of which two opposite each other, respectively along the upper side and the lower side of the fabric, form a number of ribs. The pattern warp threads are alternately rib-formingly passed around over one or several sets of weft threads and are interlaced in the fabric, while each additional pattern warp thread is inwoven in the fabric between weft threads of the sets over which other pattern warp threads are rib-formingly passed around. The additional pattern warp threads hold the weft threads of the aforesaid sets at a greater distance from each other in the fabric, so that a greater rib height is provided, and the fabric more closely approximates a loop pile fabric than the known fabrics. Furthermore with each additional pattern warp thread an additional color can be added to the fabric, so that a more varied fabric can be obtained.

13 Claims, 1 Drawing Sheet

FABRICS WITH RIB STRUCTURE ON BOTH SIDES AND METHOD OF MANUFACTURING

BACKGROUND OF THE INVENTION

This invention relates to a method for manufacturing fabrics with a rib structure, in particular false bouclé fabrics, whereby on a weaving machine, by inserting weft threads in successive sheds between warp threads of a series of warp thread systems, a fabric is formed with sets of at least two weft threads running one above the other, whereby in each warp thread system two pattern warp threads opposite each other, respectively along the upper side and the lower side of the fabric, form a number of ribs whereby these pattern warp threads alternately along their respective fabric side are rib-formingly passed around over one or several sets of weft threads and are interlaced in the fabric.

This invention also relates to fabrics with a rib structure which are manufactured according to such a method, in particular false bouclé fabrics, comprising a number of sets of at least two weft threads running one above the other which are inwoven by warp threads of a series of warp thread systems, of which two pattern warp threads opposite each other, respectively along the upper side and the lower side of the fabric, form a number of ribs whereby these pattern warp threads alternately along their respective fabric side are rib-formingly passed around over one or several sets of weft threads and are interlaced in the fabric.

A fabric with a rib structure which approximates the appearance of a loop pile fabric or bouclé fabric, is called a false bouclé fabric.

In this specification and in the claims of this patent application the terms "lower side" and "upper side" of a fabric are only used to indicate the two different sides of the fabric. The aforesaid terms must be interpreted in the sense of "the one side" and "the other side". The literal meaning of the terms "upper side" and "lower side" may therefore not give rise to any restriction on this invention.

According to a known weaving method for manufacturing a false bouclé fabric, which has the above mentioned characteristics, tension warp threads are inwoven stretched in the fabrics and in each weft insertion cycle on the weaving machine two weft threads are simultaneously inserted one above the other. In successive insertion cycles the two weft threads are in relation to the tension warp threads alternately inserted along the upper side and along the lower side of the fabric.

In warp thread systems located next to each other a first and a second pattern warp thread of a different color are provided in order to be able to make a design or a pattern visible with the two colors along the upper side of the fabric.

The first pattern warp thread is alternately rib-formingly passed over the two weft threads along the upper side of the fabric and interlaced between the two weft threads along the lower side of the fabric, in order to achieve a rib structure on the upper side of the fabric and to form the design or the pattern. The second pattern warp thread is interlaced opposite the first pattern warp thread, alternately between the two weft threads along the upper side of the fabric and passed around over the two weft threads along the lower side of the fabric. The color of the second pattern warp thread is then not visible on the upper side, but it is on the lower side of the fabric. The second pattern warp thread forms a rib structure on the lower side of the fabric. With these known fabrics the weft threads are inwoven by the pattern warp threads. With each insertion cycle a rib line is produced (alternately along the upper side and along the lower side of the fabric).

Both the upper side and the lower side of this known fabric have a rib structure. On the lower side of the fabric a type of negative (with swapped colors) is obtained of the two-colored design which is visible on the upper side of the fabric.

A disadvantage of this method is that the fabrics thus produced cannot closely approximate the appearance of the real loop pile fabrics or bouclé fabrics. Furthermore the designs or patterns provided on these fabrics only have two different colors.

SUMMARY OF THE INVENTION

The purpose of this invention is to provide a method for manufacturing a fabric with a rib structure on both sides, with which the appearance of the real loop pile fabrics is far more closely approximated, and with which at the same time the possibility also exists of forming designs or patterns with more than two colors in the fabric.

This objective is achieved according to this invention, with a method having the characteristics mentioned in the first paragraph of this specification, by providing at least one additional pattern warp thread in each warp thread system and inweaving it between weft threads of the sets over which other pattern warp threads are rib-formingly passed around.

Because of the fact that the additional pattern warp threads are between the weft threads of the aforesaid systems, they hold these weft threads at a greater distance from each other in the fabric. Because of this a greater rib height is provided, so that the rib structure becomes clearer and the fabric more closely approximates a loop pile fabric.

Furthermore with each additional pattern warp thread an additional color can be added to the fabric.

The pattern warp threads of each warp thread system preferably have a different appearance, in particular a different color, while each pattern warp thread is so provided that it has on at least one fabric side one or several visible parts corresponding to a design or pattern to be formed.

Thus a fabric is obtained with a design or a pattern whose appearance on the one hand is more varied (e.g. has greater wealth of colors), and on the other hand more closely approximates the appearance of a loop pile fabric, in comparison to existing fabrics which have a rib structure on both sides.

By utilizing the method according to this invention tension warp threads are preferably also provided in the fabric, while the sets of weft threads over which pattern warp threads along the upper side of the fabric are passed around and the sets of weft threads over which pattern warp threads along the lower side of the fabric are passed around are respectively above and below the tension warp threads.

Because of this ribs are obtained with a maximum height, so that an excellent approximation to the appearance of a loop pile fabric is obtained.

Moreover successive sets of weft threads of the fabric are preferably also provided alternately above and below the tension warp threads.

Because of this a rib is formed alternately along the upper side of the fabric and along the lower side of the fabric.

According to a very preferred method according to this invention on the weaving machine in successive insertion cycles in each case one set of weft threads is inserted.

This makes it possible in each case to form one rib per insertion cycle.

A greatly preferred fabric according to this invention is obtained if each set of weft threads consists of two weft threads running one above the other.

When weaving according to the double rapier weaving method the tension warp threads after each weft insertion cycle must be brought from a position below both rapiers to a position above both rapiers, and vice versa.

This lifting is considerable and results in a great strain of the warp threads and the weaving frames drive.

This can be remedied by manufacturing the fabric on a weaving machine with three weft insertion means (with respective insertion levels), and in the successive weft insertion cycles by not inserting a weft thread alternately in the bottom insertion level and in the top insertion level.

With this method the tension warp threads only have to be moved upward and downward over one rapier height.

Another aspect of this invention is a fabric manufactured according to the method of this invention.

Apart from the characteristics mentioned in the second paragraph of this specification a fabric according to this invention also comprises more particularly in each warp thread system at least one additional pattern warp thread which is inwoven in the fabric between weft threads of the sets over which other pattern warp threads are rib-formingly passed around.

The advantages of such a fabric in relation to the known fabrics ensue from the above mentioned advantages of the method according to this invention.

In such a fabric the pattern warp threads of each warp thread system preferably have a different appearance, in particular a different color, and each pattern warp thread is so provided that it has on at least one fabric side one or several visible parts corresponding to a fabric or pattern to be formed.

This invention will now be further explained in the following specification of two preferred methods for manufacturing false bouclé fabrics according to this invention.

These methods are only described by way of example and no part of the following specification may therefore be considered as a restriction on the protection claimed by this patent application. In this specification reference is made to the drawings attached hereto and provided with reference numbers in which

DETAILED DESCRIPTION

The method according to this invention can be implemented on a double rapier weaving machine, provided with two weft insertion means which per weft insertion cycle can insert a respective weft thread (1), (2) one above the other at a respective insertion level. On the weaving machine several warp thread systems are provided next to each other.

Figure 1:
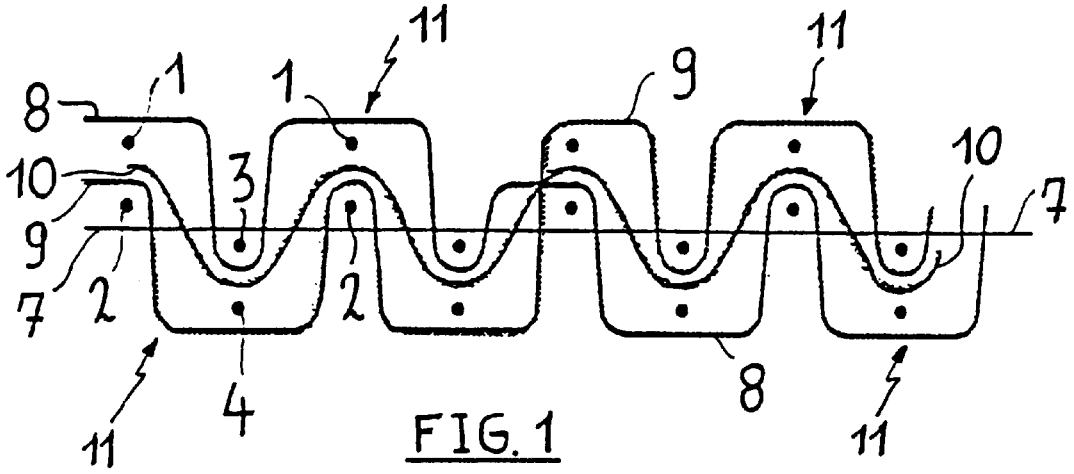
FIG. 1 represents a schematic cross-section according to the warp direction of a false bouclé fabric, manufactured according to the method according to this invention.

Each warp thread system comprises three differently colored pattern warp threads (8), (9), (10) and a tension warp thread (7). By means of a three-position jacquard machine, preferably an open-shed jacquard machine, these warp threads (7–10) are so positioned in each weft insertion cycle in relation to the aforesaid insertion levels that the weave represented in FIG. 1 is obtained; in which the weft threads (1), (2); (3), (4) inserted during successive insertion cycles are alternately above and below the tension warp threads (7), and are inwoven as sets of two weft threads (1, 2), (3, 4) running one above the other two pattern warp threads (8), (9) alternately form ribs (11) along the upper side and the lower side of the fabric because of the fact that they are alternately passed around over a set of weft threads (1, 2) located above the tension warp threads (7) and are interlaced in the fabric between the two weft threads (3), (4) of the following set of weft threads (3, 4) located below the tension warp threads (7), and a third pattern warp thread (10) is inwoven alternately between the two weft threads (3), (4) of a set of weft t threads (3), (4) located below the tension warp threads (7), and is inwoven between the two weft threads (1), (2) of a set of weft threads (1, 2) located above the tension warp threads (7).

Opposite each other, respectively along the upper side and the lower side of the fabric, the two rib-forming pattern warp threads (8), (9) form a number of ribs (11). From a specific weft insertion cycle the pattern warp thread (8) which initially formed ribs (11) along the upper side, starts to form ribs (11) along the lower side, and the pattern warp thread (9) which initially formed ribs (11) along the lower side, starts to form ribs (11) along the upper side.

This change occurs such that the different colors of these two pattern warp threads (8), (9) are visible in the correct locations on the upper side and the lower side of the fabric in order to form a respective design on each fabric side.

The method according to this invention can advantageously be implemented on a triple rapier weaving machine with three weft insertion means which are provided in order in each weft insertion cycle to insert a weft thread simultaneously at respective insertion levels.

Figure 2:
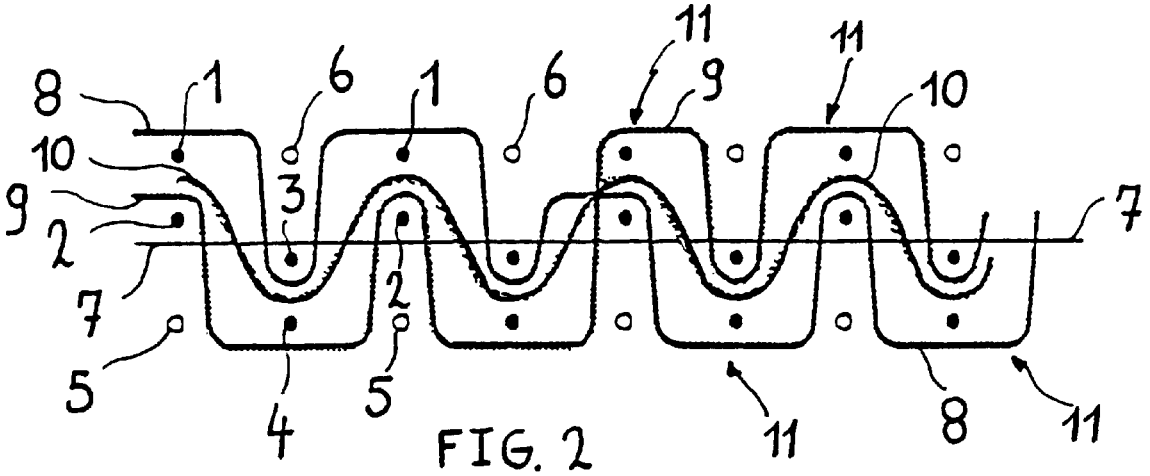
FIG. 2 represents a schematic cross-section according to the warp direction of a false bouclé fabric in which the locations are indicated where according to a variant method weft threads are not inserted.

According to this preferred method alternately no weft thread is inserted on the top insertion level (6) and on the bottom insertion level (5) (see FIG. 2) so that in each weft insertion cycle two weft threads (1), (2); (3), (4) are inserted one above the other, and the same fabric is obtained as that from FIG. 1. The tension warp threads (7) because of this only have to move over one rapier height, so that the warp threads (7–10) and the weaving frames drive are less strained.

The method according to this invention can also be implemented on a quadruple rapier weaving machine, whereby no weft threads are inserted alternately on two top and on two bottom insertion levels.

What is claimed is:

1. Method for manufacturing fabrics with a rib structure on a weaving machine comprising inserting plural weft threads in successive sheds between plural warp threads of a series of warp thread systems, forming a fabric with sets of at least two weft threads running one above another, forming plural ribs in each warp thread system with two pattern warp threads opposite each other respectively along an upper side and a lower side of the fabric, wherein the pattern warp threads, alternately along their respective fabric side, are rib-formingly passed around over one or several sets of weft threads and are interlaced in the fabric, and wherein in each warp thread system at least one additional pattern warp thread is inwoven in the fabric between the weft threads of the sets over which other pattern warp threads are rib-formingly passed around.

2. The method of claim 1, wherein the pattern warp threads of each warp thread system have a different appearance, and wherein each pattern warp thread is provided such that on at least one fabric side the pattern warp thread has one or several visible parts corresponding to a design or pattern to be formed.

3. The method of claim 2, wherein the having different appearance comprises having different colors.

4. The method of claim 1, wherein the tension warp threads are provided in the fabric, and wherein first sets of weft threads over which pattern warp threads along the upper side of the fabric are passed around and second sets of weft threads over which pattern warp threads along the lower side of the fabric are passed around are respectively above and below the tension warp threads.

5. The method of claim 4, wherein successive first and second sets of weft threads of the fabric are provided alternately above and below the tension warp threads.

6. The method of claim 1, further comprising inserting in successive insertion cycles in each case one set of weft threads on the weaving machine.

7. The method of claim 1, wherein each set of weft threads consists of two weft threads running one above the other.

8. The method of claim 1, wherein the fabric is manufactured on a weaving machine having three weft insertion means with different insertion levels, and wherein in successive weft insertion cycles no weft thread is inserted alternately in the bottom insertion level and in the top insertion level.

9. The method of claim 1, wherein the fabrics are false boucle fabrics.

10. Fabric with a rib structure comprising plural number of sets of at least two weft threads running one above another which are inwoven by warp threads of a series of warp thread systems, of which two pattern warp threads opposite each other, respectively along an upper side and a lower side of the fabric, form plural ribs, the pattern warp threads alternately along their respective fabric side are rib-formingly passed around over one or several sets of weft threads and are interlaced in the fabric, wherein in each warp thread system at least one additional pattern warp thread is also inwoven in the fabric between the weft threads of the sets over which other pattern warp threads are rib-formingly passed around.

11. The fabric of claim 10, wherein the pattern warp threads of each warp thread system have a different appearance, and wherein each pattern warp thread is provided such that on at least one fabric side the pattern warp thread has at least one visible part corresponding to a design or pattern to be formed.

12. The fabric of claim 11, wherein the different appearance is a different color.

13. The fabric of claim 11, wherein the fabric is a false boucle fabric.

* * * * *

UNITED STATES PATENT AND TRADEMARK OFFICE

CERTIFICATE OF CORRECTION

PATENT NO : 6,173,746

DATED : January 16, 2001

INVENTOR(S) : Debaes et al.

It is certified that error appears in the above-identified patent and that said Letters Patent is hereby corrected as shown below:

On the title page, under item (73), "N.V. Michael Van de Wiele" should be --N.V. Michel Van de Wiele--.

Signed and Sealed this

Eighth Day of May, 2001

*Attest:*

Nicholas P. Godici

NICHOLAS P. GODICI

*Attesting Officer*

*Acting Director of the United States Patent and Trademark Office*